US009513082B2

(12) United States Patent
Monks

(10) Patent No.: US 9,513,082 B2
(45) Date of Patent: Dec. 6, 2016

(54) METHOD AND APPARATUS FOR TRANSFERRING PAINTBALLS

(71) Applicant: Planet Eclipse Limited, Trafford Park, Manchester (GB)

(72) Inventor: Steven John Monks, Sandbach (GB)

(73) Assignee: PLANET ECLIPSE LIMITED, Manchester (GB)

( * ) Notice: Subject to any disclaimer, the term of this patent is extended or adjusted under 35 U.S.C. 154(b) by 187 days.

(21) Appl. No.: 14/064,543

(22) Filed: Oct. 28, 2013

(65) Prior Publication Data

US 2014/0123970 A1 May 8, 2014

Related U.S. Application Data

(60) Provisional application No. 61/721,550, filed on Nov. 2, 2012.

(51) Int. Cl.
*F41B 11/53* (2013.01)
*F41B 11/57* (2013.01)

(52) U.S. Cl.
CPC ..... *F41B 11/53* (2013.01); *F41B 11/57* (2013.01)

(58) Field of Classification Search
CPC ..... F41B 11/53; F41B 11/57; F41B 11/50; F41B 11/54; F41B 11/55; F41B 11/70; F41B 7/006; F41A 9/26; F41A 9/72; F41A 9/73
See application file for complete search history.

(56) References Cited

U.S. PATENT DOCUMENTS

| | | | | |
|---|---|---|---|---|
| 5,335,579 | A | 8/1994 | David | |
| 6,109,252 | A * | 8/2000 | Stevens | F41B 11/53 124/48 |
| 6,467,473 | B1 | 10/2002 | Kostiopoulos | |
| 6,978,776 | B2 * | 12/2005 | Hamilton | 124/51.1 |
| 7,445,002 | B2 * | 11/2008 | Christopher et al. | 124/51.1 |
| 2002/0020402 | A1 | 2/2002 | Kotsiopoulos | |
| 2004/0194772 | A1 | 10/2004 | Hamilton | |
| 2007/0012304 | A1 | 1/2007 | van Dorsser et al. | |
| 2009/0211562 | A1 * | 8/2009 | Karnis | 124/48 |
| 2010/0212649 | A1 | 8/2010 | Juan | |
| 2011/0011386 | A1 | 1/2011 | Tran | |
| 2012/0138036 | A1 | 6/2012 | Nguyen | |

* cited by examiner

*Primary Examiner* — Melba Bumgarner
*Assistant Examiner* — Amir Klayman
(74) *Attorney, Agent, or Firm* — Barlow, Josephs & Holmes, Ltd.

(57) ABSTRACT

A paintball transfer apparatus and method for operating the apparatus to move a paintball enable a user to load a paintball into a paintball marker. The apparatus has an housing forming a cavity for storing paintballs, a path around the wall of the cavity that is shaped to guide paintballs, and a driver that rotates a roller within the cavity. Rotation of the roller moves paintballs along the path. The path may have one of a variety of shapes, such as circular or helical. The surface speed of the roller may be greater than the speed of the paintballs along the path. The roller may be made of a high friction material, and also may be a brush. The apparatus may be used to move paintballs within and about a marker, such as vertically upwards or downwards, or horizontally left or right.

10 Claims, 6 Drawing Sheets

METHOD AND APPARATUS FOR TRANSFERRING PAINTBALLS

CROSS REFERENCE TO RELATED APPLICATIONS

This application is related to and claims priority to earlier filed U.S. provisional patent application 61/721,550, filed Nov. 2, 2012, the entire contents of which are incorporated herein by reference.

BACKGROUND OF THE INVENTION

The present invention relates to a paintball marker loading system and method.

In the sport of paintball, a paintball marker is used to propel spherical paintballs towards a target and a paintball loader or hopper is used to hold a quantity of paintballs and to supply those paintballs to the paintball marker. It is advantageous to the player participating in the sport to make use of more fragile paintballs as these require less kinetic energy in order to break upon impacting the intended target, which effectively increases the range of the paintball marker.

In traditional prior art systems the paintball loader is mounted above the paintball marker and gravity is used to encourage paintballs to transfer into the paintball marker. The problem with a loader of this type is that blockages often occur, and these blockages interrupt the continual supply of paintballs to the paintball marker.

In more recent systems this problem has been addressed with the incorporation of various rotating devices into the paintball loader in order to push paintballs from the loader, compounding the effect of gravity and ensuring a continual supply of paintballs to the paintball marker. The problem with a loader of this type is that the rotating device can apply excessive amounts of force onto the queue or "stack" of paintballs and this force can cause fragile paintballs to fracture and break.

In alternative paintball loaders rotating devices are also used to push paintballs against gravity and in this type of loader the amount of force applied to the stack of paintballs is significantly increased, thus increasing the chance of broken paintballs.

For the foregoing reasons, there is a need for a method of loading paintballs that reduces the force exerted upon the paintballs and is able to move the paintballs in any direction, without the need for a gravity based transfer system.

SUMMARY OF THE INVENTION

The present invention is directed to an apparatus and a method of transferring paintballs to the paintball marker in a way that reduces the forces exerted upon the paintballs, facilitating the use of more fragile paintballs, and in a way that enables paintballs to be moved in any direction thus negating the need for a gravity based transfer system.

A paintball transfer apparatus is configured for feeding paintballs into a feed tube connected to a paintball marker, or directly into the paintball marker. The paintball transfer apparatus has a housing or outer shell that has an inner surface (cavity wall) defining a cavity for storing paintballs, a path around the wall of the cavity that is shaped to guide paintballs, and a driver that rotates a roller within the cavity. Friction between the roller and paintballs moves the paintballs along the path. The apparatus may be used to move paintballs vertically upwards or downwards, or horizontally left or right or directions in between, without the aid of gravity.

In one embodiment, the cavity of the housing and the roller are substantially cylindrical, and concentric. The roller has an inner surface that defines an inner chamber in which paintballs can be stored before they are moved to the space between the roller and the outer shell, where they travel along the path, and eventually out of the transfer apparatus.

To allow paintballs to be dispensed from the paintball transfer apparatus into a paintball marker or a feed tube, an exit port is defined at an end of the path towards an upper end of the cavity at the upper end of the housing. The path and the exit port are dimensioned and configured so that a paintball can pass through the exit port.

Rotation of the roller with respect to the housing causes relative movement of the outer surface of the roller and the cavity wall. When a paintball is positioned along the path and in contact with the outer surface of the roller and the cavity wall of the housing, this relative movement causes the paintball to be gently sandwiched in between and move along the path, and then out of the paintball transfer device through the exit port for loading into a marker.

The orientation of the paintball transfer apparatus does not affect the movement of the paintballs along the path. When the paintballs are located along the path, they are held between the roller and the cavity wall of the housing Unlike a gravity-reliant paintball transfer apparatus, the ability of the roller to move paintballs along the path and towards the exit port is not diminished when the transfer apparatus is inverted or tilted, as may occur when a user is operating a paintball marker to which the paintball transfer is attached.

The path may have one of a variety of shapes, such as circular or helical. The surface speed of the roller may be greater than the speed of the paintballs along the path. The roller may be made of a high friction material, and also may include a brush.

A driver is provided to rotate the roller within the cavity. In one embodiment, the driver has an electric motor coupled to a motor gear. The motor can be actuated to rotate the drive gear, which in turn rotates a main drive gear adjacent to the lower surface of the roller. The main drive gear rotates the roller by way of a drive dog formed on the upper surface of the main drive gear that engages a drive dog on the roller. In one embodiment, the roller drive dog has one tooth that is received in the main drive dog, which has three teeth.

To direct paintballs in the inner chamber towards the path, in one embodiment a base having a sloped upper surface is positioned above the main drive gear. Paintballs above the base and the main drive gear are urged outwardly towards the path, where the roller can engage them and move them along the path.

Thus, paintballs in the inner chamber travel towards the path on the cavity wall. Rotation of the motor gear causes rotation of the roller relative to the outer shell, causing the paintballs to move along the path, and finally out of the exit port for use, such as for loading into a marker body for launching thereof.

It is an object of the present invention to provide a method and apparatus for loading paintballs that reduces the force exerted upon the paintballs and is able to move the paintballs in any direction, without the need for a gravity-based transfer system.

It is a further object of the invention to provide a method and apparatus capable of providing a continual supply of paintballs to the paintball marker.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

FIGS. 1-6 show embodiments of the apparatus and the above method of the present invention.

Figure 1:
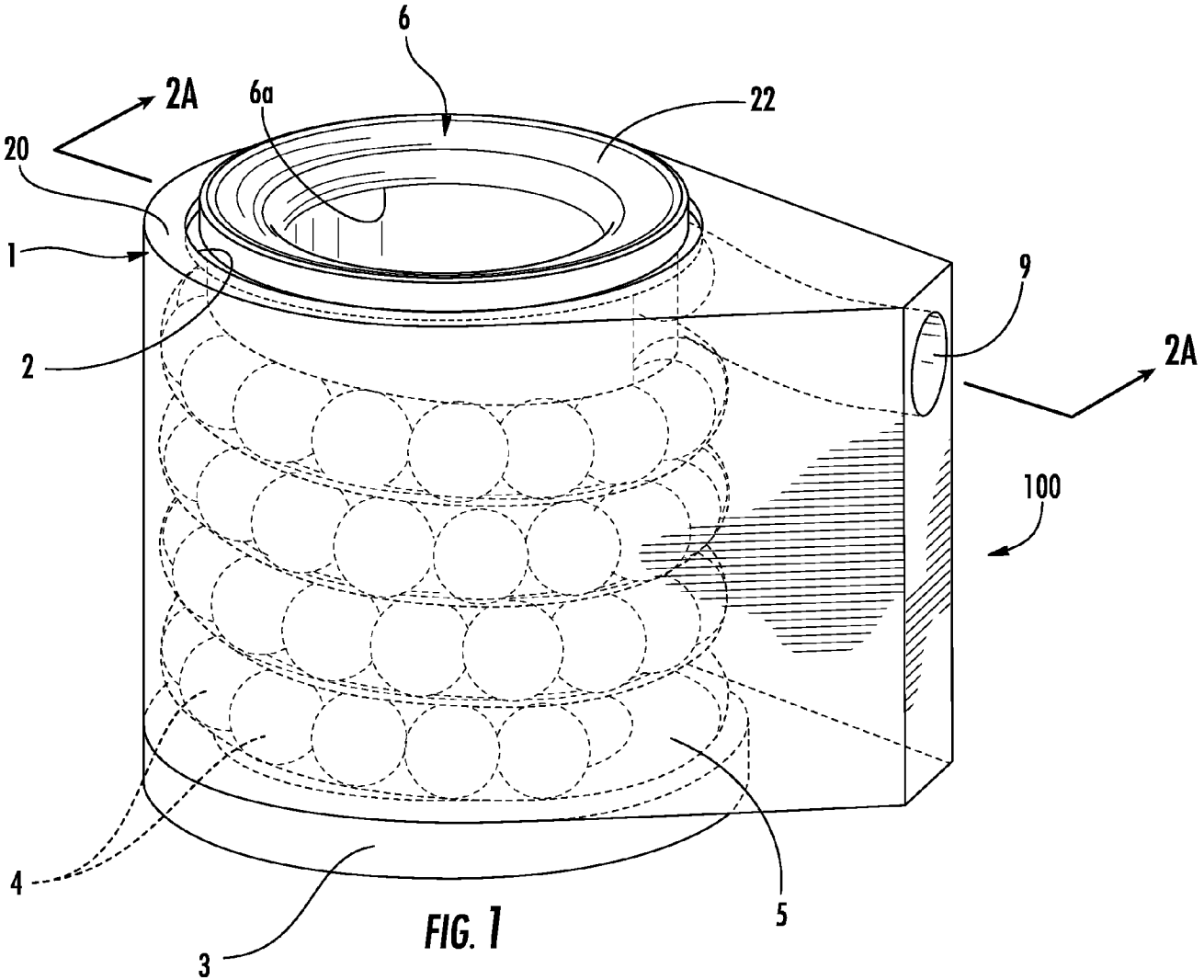
FIG. 1 shows a semi-transparent isometric view of an embodiment of the present invention.
Figure 2A:
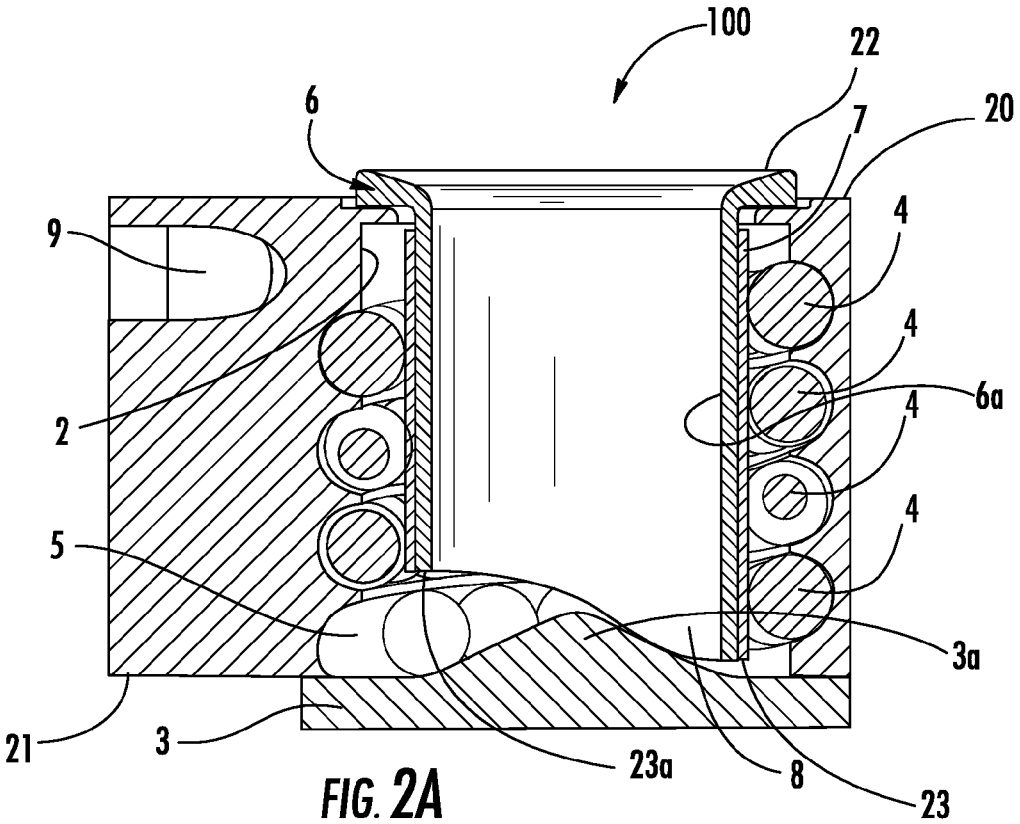
FIG. 2A shows a sectioned front elevational view through the line 2A-2A of FIG. 1 showing an embodiment of the present invention.

In FIGS. 1, 2A, 2B, 3A, and 3B, the apparatus 100 has a housing 1, such as in the form of a cylinder, the inner surface 2 of which forms a cavity wall that defines a cavity. The inner surface 2 contains a path in the form of a groove 5 shaped to accept the spherical shape of a paintball 4. A roller 6 is arranged concentrically within the cylindrical outer shell 1 and is rotatable about a preferably longitudinal central axis. The distance between the deepest point 24 of the path/groove and the outer surface 7 of the roller 6 is arranged such that a paintball seated in the path is also in contact with the outer surface of the roller, as shown in FIG. 2A. The present invention can be sized to accommodate paintballs of different diameters. The outer surface 7 of the roller has a sufficiently high coefficient of friction such that when the roller rotates about its axis any paintball 4 seated in the path/groove 5 is compelled to move along the groove in the direction of rotation as captured between the roller and the inside surface of the cylinder 1.

In this embodiment, the apparatus comprises a housing 1 that forms an essentially cylindrical cavity 2, the base 3 of which is shaped in such a way, as best seen in FIG. 2A, as to encourage paintballs 4 to roll toward the wall of the cavity. The housing 1 has an upper end 20 and a lower end 21. Around the wall of this cylindrical cavity 2 is a path in the form of a helical groove 5 that is essentially semi-circular in cross section. Positioned along the centerline of the spherical cavity 2 is a cylindrical roller 6, which has an outer surface 7 with a high coefficient of friction by virtue of the material, used to coat the surface and the surface finish of that material. The upper end 22 of the roller is adjacent to the upper end 20 of the housing 1, and the lower end 23 of the roller is adjacent to the lower end 21 of the outer shell. The inner surface 6*a* of the cylindrical roller 6 defines an inner chamber 8 in which paintballs may be stored, and is shaped in order to facilitate the transfer of paintballs from the inner chamber of the roller to the outside of the roller. The cylindrical roller 6 is driven to rotate about its axis by means of an electric motor (discussed in more detail below) in a way that will be understood by those skilled in the art. The direction of rotation of the roller 6 is such that the roller pushes the paintballs into the helical path for movement upward toward exit port 9. When the paintball transfer apparatus is tilted or inverted, the roller 6 is still capable of pushing paintballs 4 that are within the path 5 towards the exit port 9 and into the feed tube 18 for later use by a paintball marker, such for launching thereof.

Paintballs 4 are capable of entering the cylindrical cavity 2 of the apparatus through the center of the cylindrical roller 6 and can accumulate therein. The lower end 23 of the roller 6 is asymmetric, as shown in the cross section in FIG. 2A, allowing paintballs to enter the path 5. The lower end 23 of the roller has an opening along its circumference defined by a raised lower edge 23*a*. Paintballs can pass through this opening from the inner chamber of the roller and then travel outwardly into the path in the cavity between an inner surface of the housing 1 and an outer surface of the roller 6.

The paintballs 4 in the cavity and at the bottom of the inner chamber 8 of the roller are forced to the wall of the cavity 5 by the paintball guiding base 3 (in this case a tapered shaped base) of the shell and the weight of the paintballs above them. As the roller is rotated, the high friction outer surface 7 of the roller 6 pushes paintballs 4 into and along the helical groove 5. The paintballs 4 within the cylindrical roller 6 are agitated by the small protrusions from the inner surface of the roller 6 and fall into the space left vacant by the paintballs 4 that have been pushed into the helical groove 5. As the roller 6 continues to rotate, the paintballs 4 travel along the helical groove 5 to an exit port 9 at the top of the apparatus 100.

The housing 1 and the roller 6 may be made from a wide range of materials such as plastic, metal, or similar materials or combinations thereof. The housing 1 and the roller 6 may be made of different materials or the same material.

The high friction coefficient on the roller 6 may be obtained in various ways. For example, the inherent material properties of the material used to form the roller 6 may provide sufficient friction. Also, the roller 6 may be machined to have a rough surface by forming a knurled or grooved surface, for example. In another embodiment, the outer surface 7 of roller 6 surface can be coated with a high friction coating. The roller surface may also be in the form of a brush or may be rubber or other material that can provide the required frictional gripping. In some embodiments, the surface of the roller 6 may include portions having varying friction coefficients. The roller 6 and outer surface of the roller may be made of different materials or the same material.

The roller 6 may have a contoured surface that engages the paintballs 4 to push them along the path rather than roll them along the path.

The path on the surface of the cavity 5 may be shaped as a semi-circular groove in one embodiment, but it may take on any shape that is capable of contacting and moving a paintball 4. For example, a path in the form of a V-notch groove would allow two-point contact of the paintballs 4 with the groove to support them as they travel. The path may even have a varying shape, as long as the path is capable of supporting and moving paintballs 4.

Also, the path may be helical or circular in some embodiments, or it may take any other form that allows the roller 6 to advance the paintballs 4. The path may incorporate helical portions and circular portions, as well as portions that are non-circular and non-helical, or any combination of these.

The paintballs 4 may be fed through the inner surface 6*a* into inner chamber 8 of the cylindrical roller 6 using gravity. Other mechanisms may be used to move the paintballs 4 from the inner chamber 8 of the inside of roller 6 to the path. Although the roller 4 is shown in FIG. 2A in a vertical orientation, the roller 4 and cavity of the housing 1 may be provided in another orientation that allows gravity to aid in moving the paintballs 4 toward the helical groove 5 in cooperation with the base and the inner surface of the roller 6.

Figure 2B:
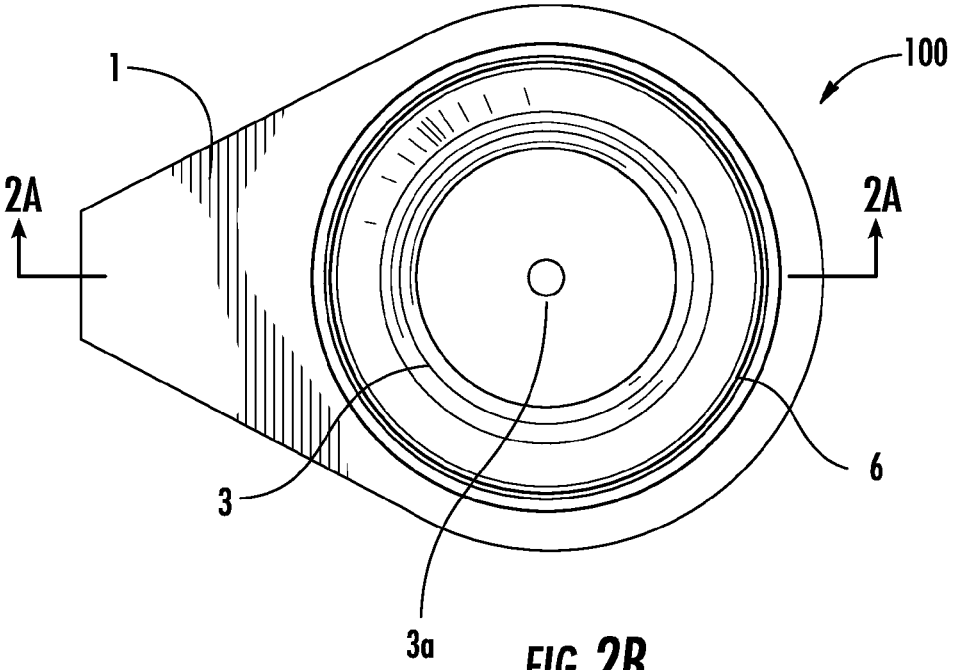
FIG. 2B shows a plan view of the embodiment of the present invention of FIG. 2A.
Figure 3A:
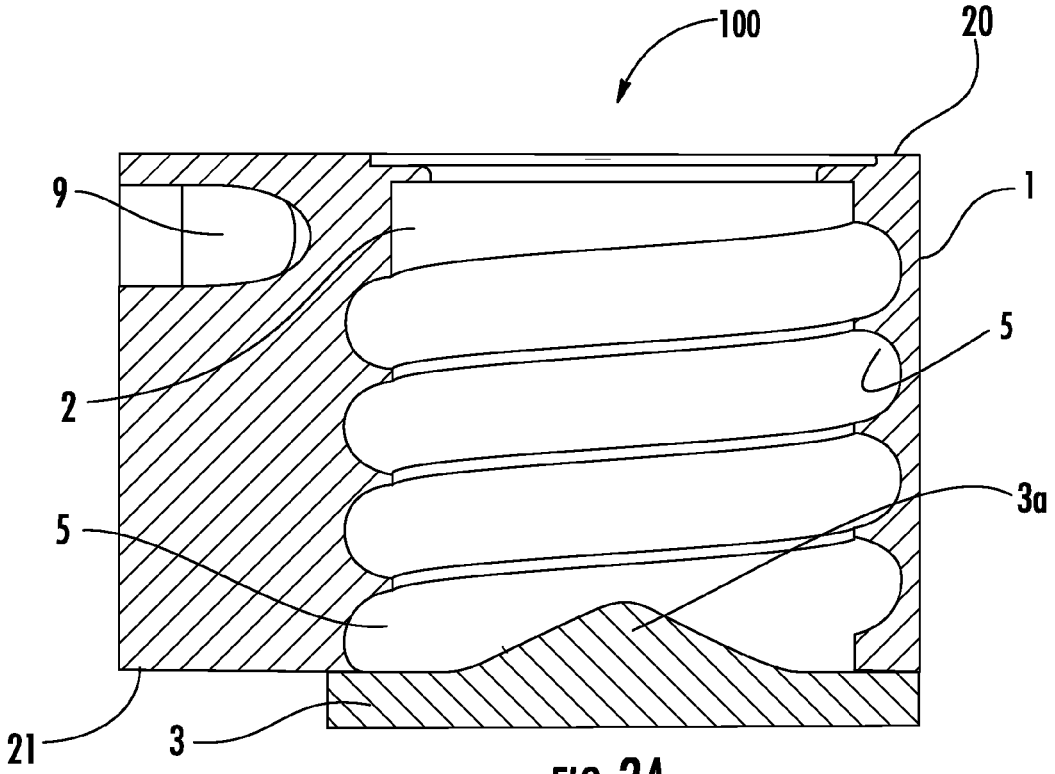
FIG. 3A shows a sectioned front elevation, through the line 3A-3A of FIG. 3B, of an embodiment of the invention with roller and paintballs removed.
Figure 3B:
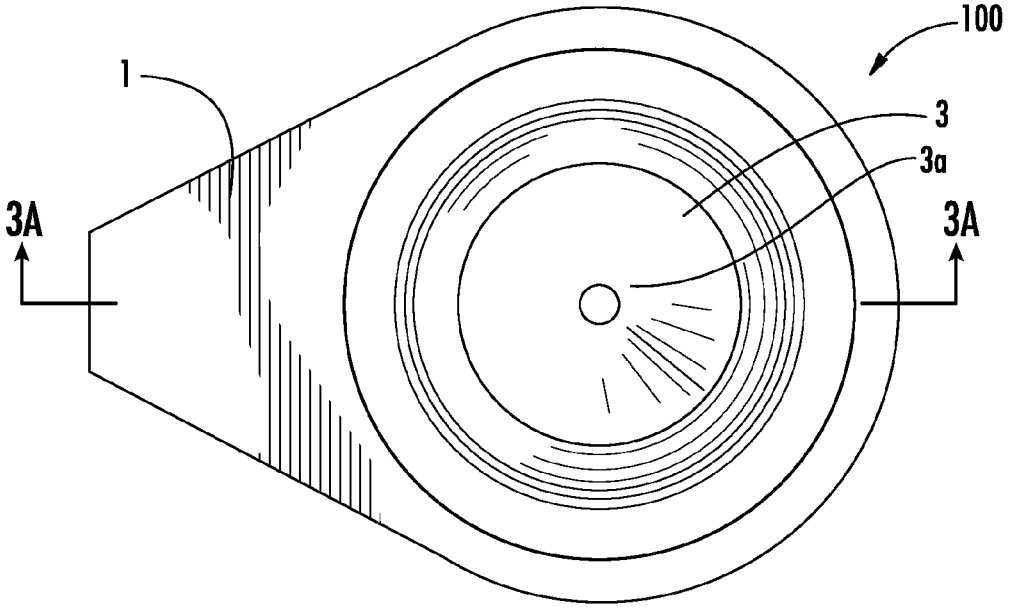
FIG. 3B shows a plan view of the embodiment of the invention of FIG. 3A with roller and paintballs removed.

Although the inner surface 6*a* of the cylindrical roller 6 is shown in FIG. 2B as a smooth surface, it may be contoured in a way that aids in directing the paintballs 4 from the inner surface 6*a* of the roller 6 to the groove 5. Similarly, the base 3 is shown as having a single protrusion 3*a* to help direct the paintballs 4 to the groove 5, but it may have a plurality of protrusions that aid in directing the paintballs 4 to the groove 5.

Figure 4:
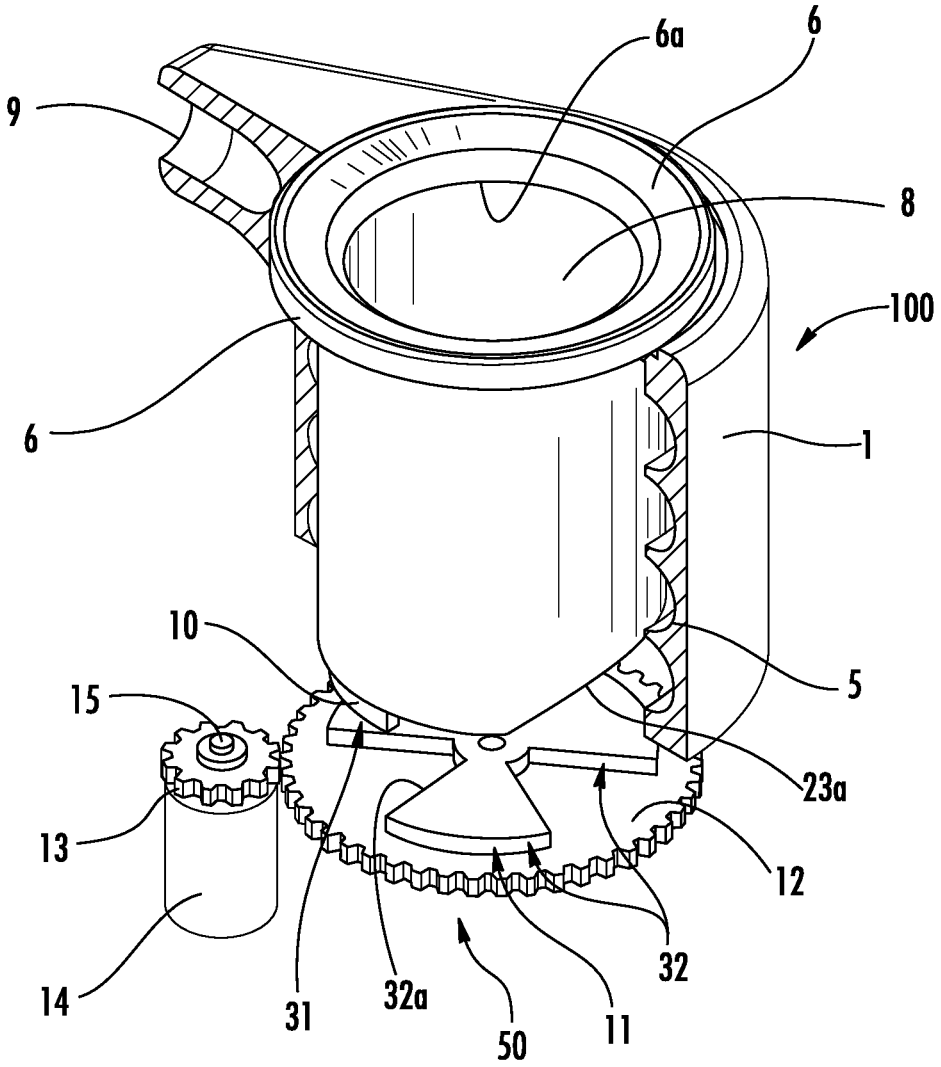
FIG. 4 shows an exploded view of a possible drive configuration of the present invention.
Figure 5:
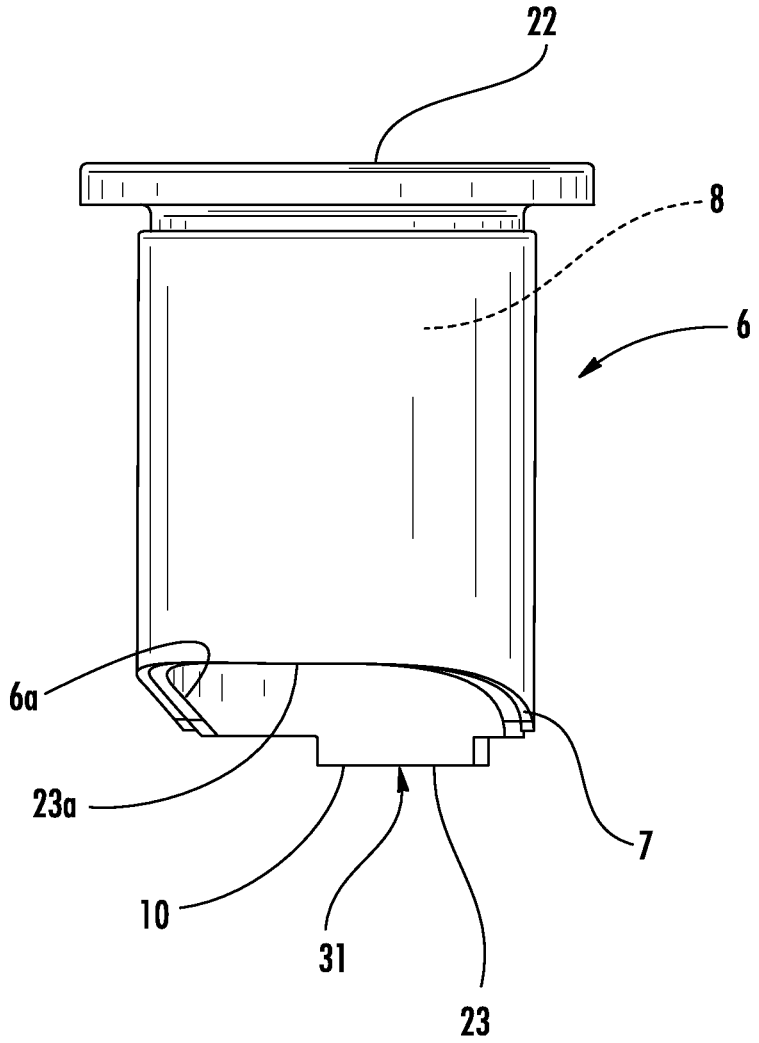
FIG. 5 shows a view of an embodiment of the roller of the present invention.

The roller 6 may be rotated by a drive mechanism. FIG. 4 shows an embodiment of the paintball transfer apparatus 100 including the drive mechanism, generally referred to as 50, for rotating the roller 6 within the housing 1. The roller 6 has a roller drive dog 10 having one tooth 31, which is shown in FIG. 5. The roller drive dog 10 is received in a slot 32A between the teeth 32 of a three tooth drive dog 11, which is an integral part of the main drive gear 12. To rotate the drive dog 11, the main drive gear 12 meshes with a motor gear 13 clamped or otherwise secured to the shaft 15 of an electrical motor 14. The motor 14 may be driven by an electrical circuit on a printed circuit board (not shown) in a manner that is commonplace and well understood by those skilled in the art. The motor 14, the motor gear 13, and the main drive gear 12 are all fixed relative to the housing 1. In FIG. 4, the motor gear 13 rotates about a motor gear axis, and the main drive gear 12 rotates about a main drive gear axis that is collinear with the axis of the roller 6.

Drive mechanisms other than an electric motor 14 can be used to rotate the roller 6 without departing from the scope of the present invention. For example, the drive mechanism 50 may be powered by compressed air, or may be hand operated.

More or fewer teeth 32 may be used on the roller drive dog 10 and the drive dog 11, but they must be configured so that they engage each other so that rotation of the motor 14 causes rotation of the roller 6.

Although not shown, the embodiment of FIG. 4 can include a paintball guiding base 3 for directing the paintballs 4 within the inner chamber 8 into the path 5, similar to the base 3 shown in FIG. 2A. The paintball guiding base 3 is positioned above the drive dog 11 of the main drive gear 12, but is rotatably secured to the housing 1, so that the base 3 does not rotate with the main drive gear 12. The base 3 is configured so that it does not interfere with engagement of the roller drive dog 10 with the drive dog 11 of the main drive gear 12. In one embodiment, the center of the base 3 is fixed to a spindle that passes through the center of the main drive gear and prevents it from rotating with the roller 6.

Figure 6:
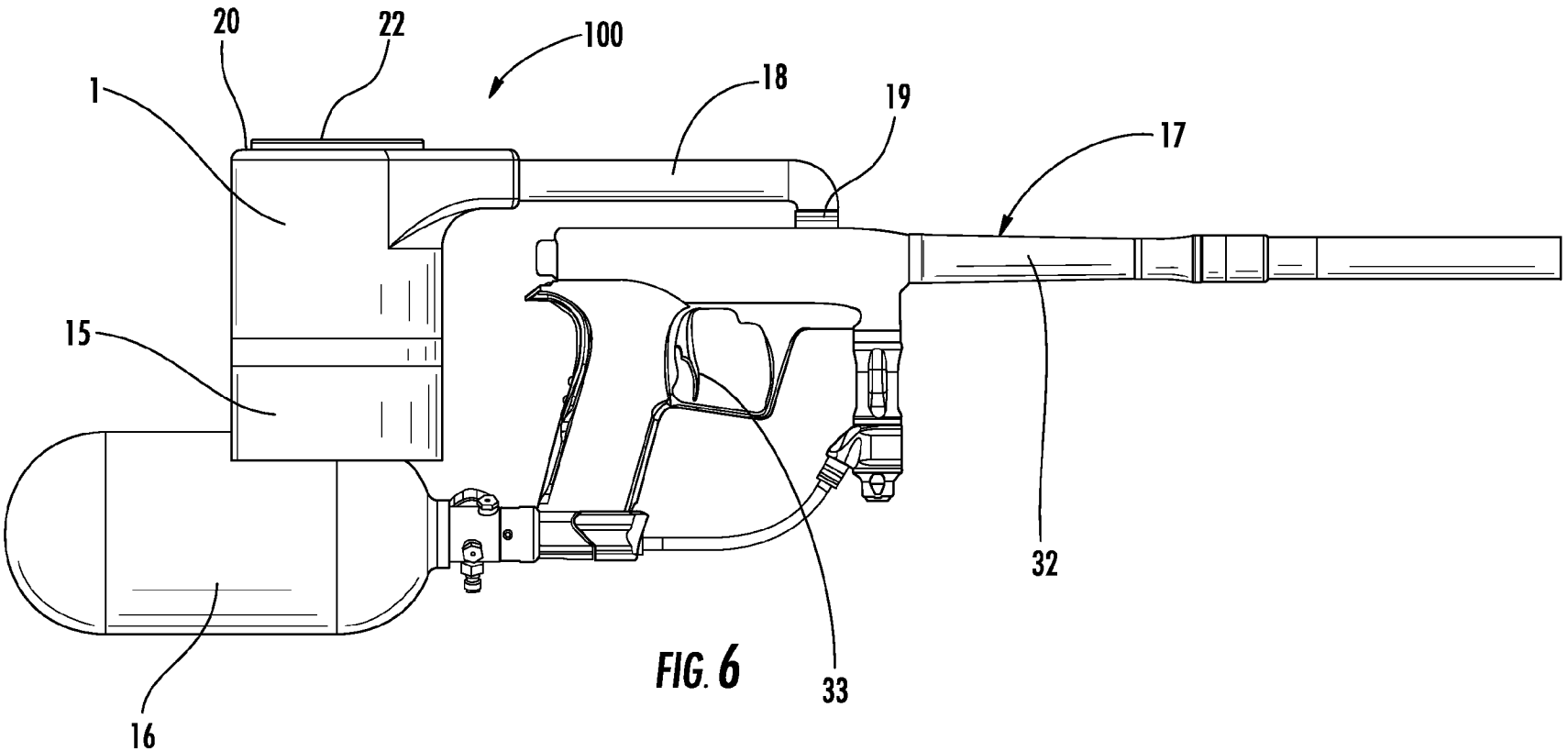
FIG. 6 shows a schematic view of the paintball transfer apparatus of the present invention in the preferred mounting location on a paintball marker.

The paintball transfer apparatus 100 may be secured to a variety of paintball markers 17, as in FIG. 6, shows the paintball transfer apparatus 100 in its preferred location when secured to a paintball marker 17. The housing 1 is fixed to a mounting adaptor 15, which becomes an integral part of the paintball transfer apparatus 100 and which is arranged to fit neatly onto a compressed air cylinder 16 which is attached to, and provides the air supply for, a paintball marker 17. Paintballs 4 are fed from the paintball transfer apparatus 100 into the feed neck 19 of the paintball marker 17 by means of a feed tube 18.

It can be seen that securing the present paintball transfer apparatus 100 to a paintball marker 17 can be accomplished without obstructing a user's access to components on the paint marker 17 itself, such as the trigger 33 or the barrel 32.

The paintball transfer apparatus 100 may be affixed to paintball markers 17 having designs other than the one shown. The paintball transfer apparatus 100 may be configured so that it feeds paintballs 4 directly into the paintball marker 17, rather than indirectly through a feed tube 18.

Although the figures show a roller 6 and a cavity 5, and associated path, that are substantially cylindrical, in some embodiments, it may be advantageous to move the paintballs along a path formed on an object other than a cylinder. For example, a path could be formed on a first surface, and a second surface could be positioned in facing relation with the first. Then a paintball 4 can be directed to the path on the first surface so that the paintball 4 is between the first and second surfaces. The first and second surfaces can be moved relative to each other to cause the paintball 4 to move along the path. The first and second surface could be substantially flat, or they could be formed of another geometrical shape.

Although the figures show a roller 6 having an inner chamber 8 for storing paintballs 4 that can be fed into the path, it is possible to use other structures and methods to load paintballs 4 into the path. For example, another feeding mechanism could be placed adjacent to the path 5 and the roller 6, so that the feeding mechanism independently feeds paintballs 4 into the path, and the roller 6 moves the paintballs 4 along the path 5 to the exit port 9. In such an embodiment, the roller 6 is formed without an inner chamber 8.

It can therefore be seen that the paintball transfer apparatus 100 of the present invention provides a method and apparatus for moving paintballs 4 in any direction, without the need for a gravity-based transfer system. The present invention also provides a method and apparatus capable of providing a continual supply of paintballs 4 to a paintball marker 17.

The foregoing embodiments are described by way of example only. It would be appreciated by those skilled in the art that various changes and modifications can be made to the illustrated embodiments without departing from the spirit of the present invention. All such modifications and changes are intended to be covered by the appended claims.

What is claimed is:

1. A paintball transfer apparatus for feeding paintballs into a paintball marker, the paintball transfer apparatus comprising:

a housing having an outer wall with an inner surface, the outer wall defining a cavity within the housing in which paintballs are capable of being stored, the housing having an upper end and a lower end;

a path formed on the inner surface of the outer wall, the path being shaped to guide paintballs, the path comprising a helical path portion;

an input port opening defined at a first end of the path so that paintballs may pass into the path through the input port opening;

an exit port defined at a second end of the path adjacent to the upper end of the housing, the exit port being configured so that a paintball may exit the path through the exit port;

a cylindrical roller, having an outer surface and an inner surface, positioned within the cavity and being configured to rotate about a roller axis; the inner surface of the roller defining a chamber with an open top end to receive paintballs downwardly thereinto the chamber by gravity and a bottom open end; the bottom open end being disposed above the lower end of the housing; the bottom open end of the roller being in communication with the input port opening at the first end of the path to permit movement of paintballs from the chamber in the roller into the path by gravity;

the paintballs being movably secured between the inner surface of the outer wall of the housing and the outer surface of the roller;

a drive mechanism for rotating the roller;

wherein the drive mechanism causes rotation of the roller relative to the housing, thereby causing paintballs located between the inner surface of the outer wall of the housing and the outer surface of the roller to travel upwardly along the path against the forces of gravity and out through the exit port.

2. The paintball transfer apparatus of claim 1, wherein the drive mechanism comprises:

a roller drive dog extending downwardly from the lower end of the roller, the roller drive dog having at least one tooth;

a main drive gear;

a drive dog defined on an upper surface of the main drive gear, the drive dog having three teeth and being configured to engage the at least one tooth of the roller drive dog;

a motor gear, the motor gear being positioned to engage the main drive gear, the motor gear having teeth that mesh with teeth on the main drive gear so that rotation of the motor gear causes rotation of the main drive gear;

an electric motor linked to the motor gear and configured to rotate the motor gear.

3. The paintball transfer apparatus of claim 1, further comprising:

a paintball guiding base having a sloped upper surface for directing paintballs from the chamber of the roller into the input port opening by gravity.

4. The paintball transfer apparatus of claim 3, wherein the paintball guiding base is rotatably fixed with respect to the housing.

5. The paintball transfer apparatus of claim 1, wherein the outer surface of the roller comprises a friction material.

6. The paintball transfer apparatus of claim 1, wherein the path further comprises a circular portion.

7. A method of feeding paintballs into a paintball marker, the method comprising the steps of:

providing a housing that has an outer wall, the outer wall defining a cavity in which paintballs are capable of being stored, the housing having an upper end and a lower end;

providing a path formed on an inner surface of the outer wall, the path being shaped to guide paintballs, the path comprising a helical path portion;

positioning a cylindrical roller within the cavity, the roller, having an outer surface and an inner surface, being configured to rotate about a roller axis; the inner surface of the roller defining a chamber with an open top end to receive paintballs therein by gravity and a bottom open end; the bottom end being disposed above the lower end of the housing;

introducing paintballs into the chamber via the top open end and retaining the paintballs in the chamber by gravity;

providing an input port opening defined at a first end of the path;

passing paintballs through the bottom open end of the roller by gravity into the path via the input port opening;

positioning at least one paintball along the path;

rotating, via a drive mechanism, the roller to move the paintball upwardly along the path against the forces of gravity while paintballs are located between the outer surface of the roller and the inner surface of the outer wall of the housing; and causing the at least one paintball to pass through an exit port at an end of the path.

8. The method of claim 7, wherein the step of rotating the roller further comprises the steps of:

providing a main drive gear at the lower end of the roller for rotating the roller;

rotating the roller relative to the housing by actuating a motor gear connected to a main drive gear, the main drive gear having a drive dog on an upper surface of the main drive gear, the drive dog engaging a roller drive dog extending downwardly from the roller and having at least one tooth;

wherein the step of actuating the motor gear is performed by an electric motor.

9. The method of claim 8, wherein the step of positioning the at least one paintball along the path further comprises the steps of:

directing the at least one paintball towards the path by providing a sloped upper surface on a paintball guiding base positioned above the main drive gear for directing paintballs from the chamber defined by the roller into the input port opening by gravity.

10. The method of claim 7, further comprising the step of:

providing a surface on the roller that is a friction material.

* * * * *